US007651418B2

(12) United States Patent
Appleton et al.

(10) Patent No.: US 7,651,418 B2
(45) Date of Patent: Jan. 26, 2010

(54) STRUCTURED LACROSSE STICK

(75) Inventors: Douglas S. Appleton, San Carlos, CA (US); Blakeley E. Kim, San Francisco, CA (US); Cortland R. Kim, San Francisco, CA (US); Dean E. Wilson, Bellevue, WA (US); Stanley Botten, Vashon Island, WA (US)

(73) Assignee: Talon Lacrosse, LLC, San Carlos, CA (US)

( * ) Notice: Subject to any disclaimer, the term of this patent is extended or adjusted under 35 U.S.C. 154(b) by 366 days.

(21) Appl. No.: 11/748,469

(22) Filed: May 14, 2007

(65) Prior Publication Data

US 2008/0287226 A1 Nov. 20, 2008

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

| | | | | |
|---|---|---|---|---|
| 4,037,841 | A | 7/1977 | Lewis | |
| 4,206,918 | A | 6/1980 | Lewis | |
| 4,351,528 | A | 9/1982 | Duplin | |
| 4,890,355 | A | 1/1990 | Schulten | |
| 5,048,843 | A * | 9/1991 | Dorfi et al. | 473/513 |
| 5,482,270 | A | 1/1996 | Smith | |
| 5,867,868 | A | 2/1999 | Ward | |
| 5,888,601 | A * | 3/1999 | Quigley et al. | 428/36.1 |
| D445,472 | S | 7/2001 | Tucker | |
| 6,267,697 | B1 * | 7/2001 | Sulenta | 473/560 |
| 6,500,079 | B1 | 12/2002 | Tucker | |
| 6,702,697 | B1 * | 3/2004 | Lussier et al. | 473/561 |
| 6,752,730 | B1 | 6/2004 | Brine | |
| 6,904,615 | B2 * | 6/2005 | Kobe et al. | 2/161.8 |
| 2002/0037780 | A1 * | 3/2002 | York et al. | 473/560 |
| 2007/0184923 | A1 * | 8/2007 | Morrow | 473/513 |

OTHER PUBLICATIONS

Webpage download, RetroRailgun, 2000, http://web.archive.org/web/20001020140842/http://www.hautestick.com/LaxGear/LaxShaft/Retro/Retro-Main.html, 3 pages.*

* cited by examiner

*Primary Examiner*—Gene Kim
*Assistant Examiner*—Mike Chambers
(74) *Attorney, Agent, or Firm*—Xin Wen

(57) ABSTRACT

A structured lacrosse shaft includes a head portion configured to be connected to a lacrosse head, an end portion configured to be capped by an end cap, and a middle portion. At least one of the head portion, the end portion, or the middle portion includes an interior portion and an outer layer on an outer surface of the interior portion. The outer layer comprises wood veneer.

16 Claims, 5 Drawing Sheets

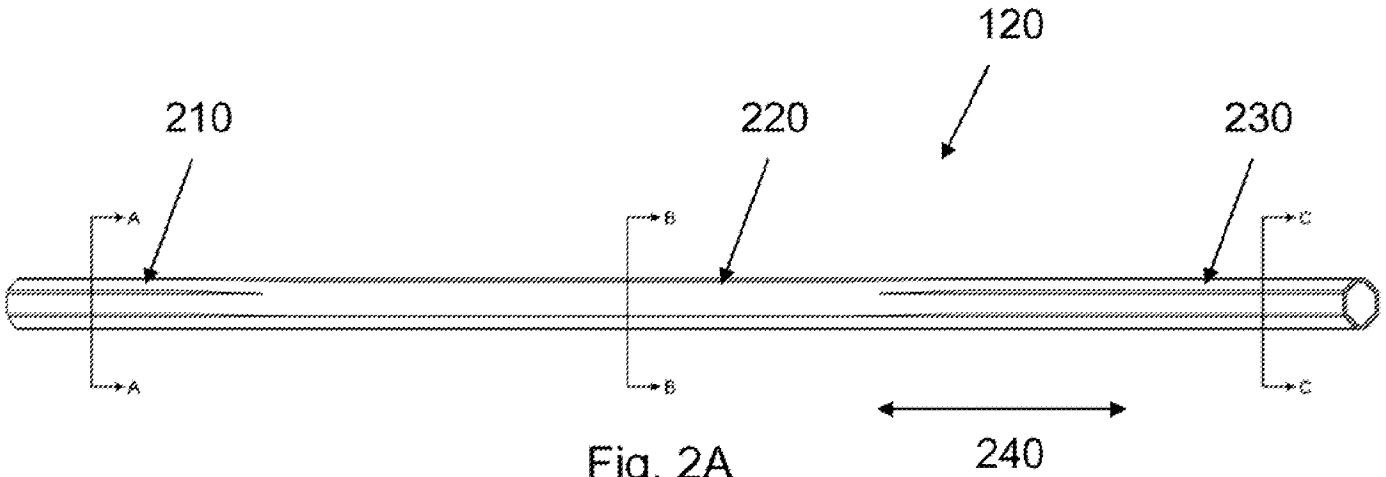
Fig. 2A
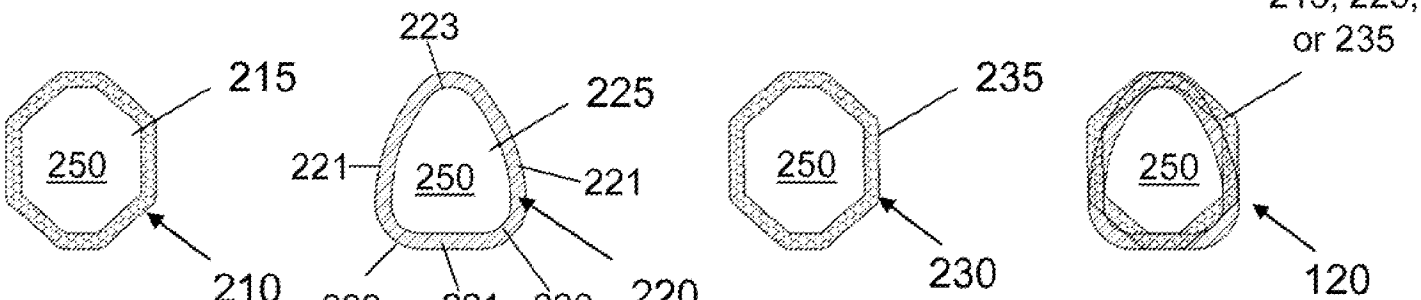
Fig. 2E
Fig. 2D
Fig. 2C
Fig. 2B

STRUCTURED LACROSSE STICK

The present application claims priority to commonly assigned US Design patent applications Ser. No. 29/277,292, entitled "Talon-grip end cap for a lacrosse shaft" filed Feb. 20, 2007, and Ser. No. 29/277,292, entitled "Lacrosse shaft having varied cross-sectional shapes" filed Feb. 20, 2007, the contents of which are incorporated herein by reference.

BACKGROUND

The present invention relates to the field of sports equipment, and, more particularly, to lacrosse sticks.

Lacrosse is an ancient game that originated with the Native Americans in North America, particularly in the northeastern United States and Canada. Traditionally, lacrosse sticks were made of wood, usually hickory or ash, and were one integrated piece of equipment. The lacrosse sticks were handcrafted and varied in strength, weight, feel, and balance in the player's hands. These wooden handles were susceptible to breakage, were heavy, and had inconsistent quality, which proved disadvantageous in both playability and safety. Because the shafts and the lacrosse stick head were one integrated piece of equipment, if the shaft broke, the entire stick had to be replaced.

Molded plastic lacrosse stick head, developed in 1967, revolutionized the sport of lacrosse. Molded plastic (disclosed in U.S. Pat. No. 3,507,495) allowed lacrosse sticks to be mass produced with consistent quality and shape. Wood shafts continued to be used, although they were still susceptible to breakage and were heavy.

In the 1970s, shafts of metallic construction, as described in U.S. Pat. No. 4,037,841, were developed. These metal shafts, in large measure, replaced the wood shafts, particularly in the men's game. The advantage of such construction was that the metal shafts could be mass produced with uniform quality, strength and weight, and were generally stronger than wood shafts.

In lacrosse, hockey or other stick sports, players move and change their hand placement along the shaft to perform different skills. In lacrosse in particular, various combinations of hand placement are a critical part of the game, as it is essential for effective stick handling when cradling, scooping, throwing, or shooting the ball. In addition, when shooting or passing the ball, the player needs to have a firm grip on the shaft in order to maximize the force and torque, which produces a faster shot or pass.

Without a firm grip, a player can often lose control of the shaft and the shaft can slip in a player's grasp. This is particularly true given playing and weather conditions such as fatigue, perspiration, cold and hot temperatures, and/or wet weather. In addition, men's lacrosse and ice hockey require the players to use gloves that protect the hands but which reduce the player's feel and grip on the shaft.

Typically, manufacturers design handles for sports shafts that require variable hand placement without a grip as it makes the manufacturing process easier. To improve grip, players often use athletic tape on their shafts in locations that coincide with their hand placement in order to improve stick control, produce faster shots, serve as a tactile cue for hand placement when stick handling, and accommodate their individual playing style and preference.

Although these tape alterations may improve grip, it is difficult to build shapes out of the tape that complement hand placement. Furthermore, a tape rarely adheres well to the shaft and is susceptible to peeling and wearing off over time. Thus, players must constantly remove and replace the tape.

Moreover, if the lacrosse shaft breaks, then the player must re-tape and re-customize his or her new shaft to try to replicate the grip design from the broken shaft.

Other efforts to provide improved grip and control of sticks or handles include separate sports grips applied over a straight shaft. U.S. Pat. No. 6,500,079 to Tucker, Sr., for example, teaches a variable hand placement sports equipment shaft or handle, such as a lacrosse stick, that includes a shaft and at least one overlay attached to the shaft at a location of frequent hand placement that contains ribs, grooves, hourglass and conical shapes. The overlays are preferably made of a material that is soft, pliable, deformable and tacky so as to provide the player with a better grip on the handle. Similar overlays are disclosed in U.S. Pat. No. 4,890,355 to Schulten, U.S. Pat. No. 5,482,270 to Smith, and U.S. Pat. No. 5,867,868 to Ward.

Other modifications on Lacrosse shafts have also been developed for improved handling. For example, U.S. Patent Application Publications 2005/0130759 and 2005/0130773, both to Hayden et al., teach lacrosse sticks with an improved grip and feel due to expanded portions and contoured locations for users' hand(s). An inward tapered portion and expanded portion allegedly assist a player in controlling the shaft, cradling a ball, passing and shooting. Hayden et al. further disclose an outer surface of the shaft coated with a gripable material to improve the overall grip and feel characteristics of the shaft.

U.S. Pat. No. 2,031,161 to Hamel discloses bulbous portions adapted to more comfortably fit the shape of the human hand and grooves to provide inter-engaging portions into which a hand becomes partially molded. U.S. Patent Application Publication 2004/0087395 to Manory discloses a hockey stick shaft having a concave/sided oval cross-sectional configuration. U.S. Design Pat. D475,425 S shows a cricket bat with a contoured handle, which may accommodate finger gripping. Other types of contoured shafts are disclosed in U.S. Pat. No. 4,351,528 to Duplin, U.S. Pat. No. 6,752,730 to Brine, Jr. et al., and U.S. Pat. No. 4,206,918 to Lewis, Jr.

Although conventional Lacrosse sticks include features for accommodating players hand positions, there is therefore a need to further improve various performances for Lacrosse sticks such as optimized control of the shaft, increased shaft strength, more desirable tactile features, and higher flexibility. It is also desirable to provide Lacrosse sticks having improved grip, leverage, and torque for improved shot speed.

SUMMARY OF THE INVENTION

In a general aspect, the present invention relates to a structured lacrosse shaft includes a head portion configured to be connected to a lacrosse head, an end portion configured to be capped by an end cap, and a middle portion. At least one of the head portion, the end portion, or the middle portion includes an interior portion and an outer layer on an outer surface of the interior portion. The outer layer comprises wood veneer.

In another general aspect, the present invention relates to a contoured lacrosse shaft that includes a head portion configured to be connected to a lacrosse head, an end portion configured to be capped by an end cap, and a middle portion. At least one of the head portion, the end portion, and the middle portion comprises a hollow core. Each of the head portion, the end portion, or the middle portion comprises an interior portion and an outer layer made of wood veneer on an outer surface surrounding the interior portion. A cross section of the middle portion has a different shape from the cross sections at the head portion and at the end portion.

In another general aspect, the present invention relates to a lacrosse stick that includes a structured shaft including a head portion configured to be connected to a lacrosse head, an end portion configured to be capped by an end cap, and a middle portion. At least one of the head portion, the end portion, or the middle portion comprises an interior portion and an outer layer made of wood veneer on an outer surface of the interior portion. The lacrosse stick also includes an end cap including a sleeve portion configured to cap the end portion of the shaft and a round portion having one or more protruded grip features on a surface of the round portion.

In another general aspect, the present invention relates to an end cap for a lacrosse shaft. The end cap includes a sleeve portion configured to cap an end portion of the shaft and a round portion having four protruded talons disposed on a surface of the round portion.

Implementations of the system may include one or more of the following. The outer layer can wrap around at least a segment of the interior portion. The outer layer can have a thickness in the range of 0.003 inch to 0.5 inch. Each of the head portion, the end portion, and the middle portion can include the interior portion and the outer layer on an outer surface of the interior portion. The interior portion can include a hollow core. The interior portion can include a material selected from the group of fiberglass, aluminum, chrome, aluminum alloy, titanium, Kevlar, scandium, magnesium, and graphite loaded plastics. Cross sections at the head portion and the end portion of the shaft can have a polygon shape. A cross section of the middle portion can have a different shape from the cross sections at the head portion and at the end portion. The cross section of the middle portion of the shaft can include three sides and three corners. The three corners have acute angles and one of the three corners can have a more acute angle than the other two of the three corners.

Embodiments may include one or more of the following advantages. The disclosed Lacrosse stick can provide improved shaft control, and higher flexibility. The disclosed shaft can provide higher strength, especially in the middle portion, in comparison with the conventional lacrosse shafts. The disclosed lacrosse shaft may be less likely to break in vulnerable situations such as a cross-check. The disclosed shaft also provides an end cap that can provide improved leverage and torque and thus improved shot speed. The materials and structures of the disclosed lacrosse stick can also make the lacrosse stick to be dent resistant and extremely durable. The surface of the lacrosse stick can have desirable tactile features such as being tacky and slip resistant. The disclosed shaft can also provide a player a tactile indication to the orientation of the lacrosse head, which allows a player to know the orientation of the head without looking at the lacrosse stick.

The disclosed end cap can provide leverage and torque for improved shot speed. The grip features such as talons on the surface of the end cap can further improve a player's grip of the end cap as well as provide tactile clues for correct hand position on the shaft.

Although the invention has been particularly shown and described with reference to multiple embodiments, it will be understood by persons skilled in the relevant art that various changes in form and details can be made therein without departing from the spirit and scope of the invention.

BRIEF DESCRIPTION OF THE DRAWINGS

The following drawings, which are incorporated in and from a part of the specification, illustrate embodiments of the present invention and, together with the description, serve to explain the principles of the invention.

FIG. 2A is a detailed perspective view of the contoured lacrosse shaft in FIG. 1.

FIG. 2B is a cross-sectional view of the contoured lacrosse shaft along line A-A in FIG. 2A.

FIG. 2C is a cross-sectional view of the contoured lacrosse shaft along line B-B in FIG. 2A.

FIG. 2D is a cross-sectional view of the contoured lacrosse shaft along line C-C in FIG. 2A.

FIG. 2E is an end view of the contoured lacrosse shaft of FIG. 2A.

DETAILED DESCRIPTION

Figure 1:
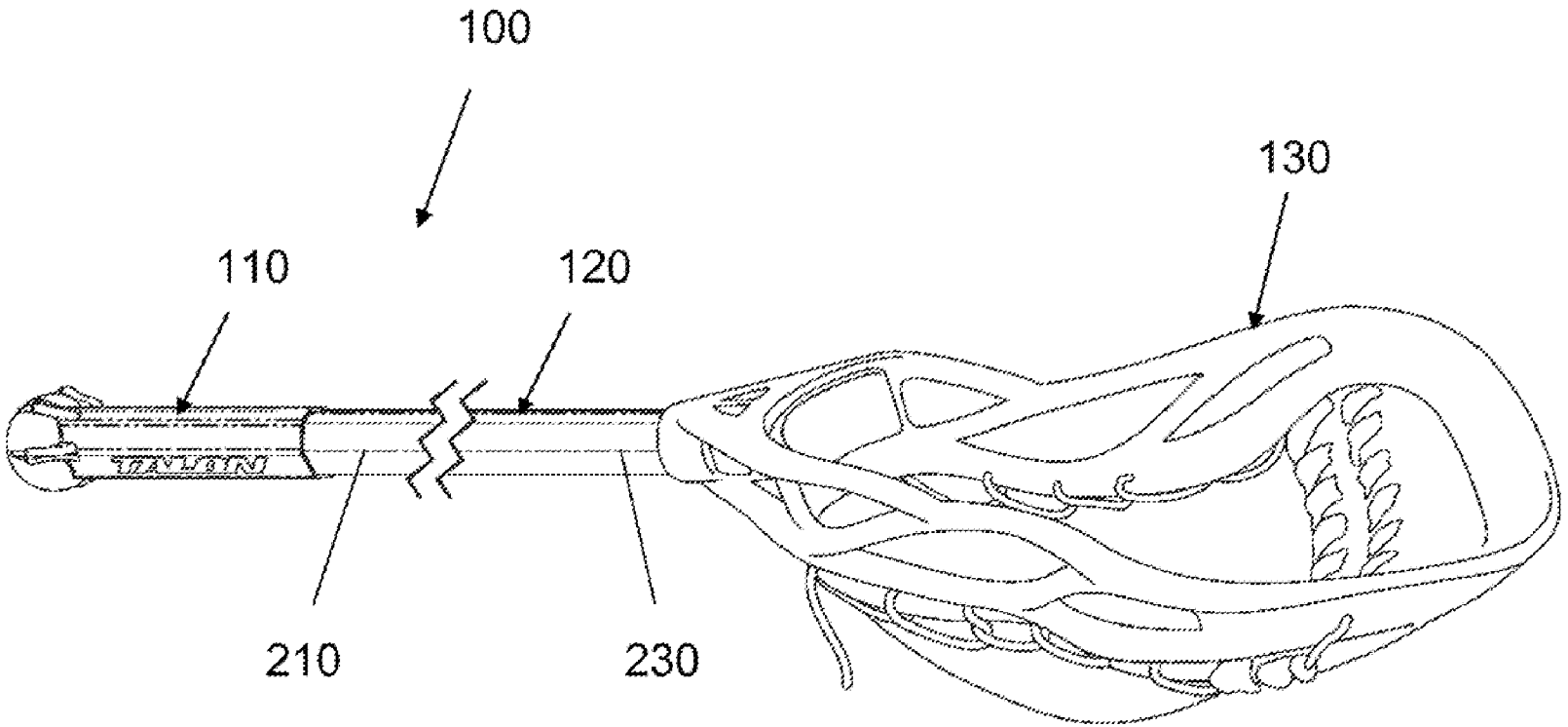
FIG. 1 is a perspective view of a lacrosse stick having a contoured shaft and a talon-grip end cap.

Referring to FIG. 1 and FIGS. 2A-2B, a lacrosse stick 100 includes a talon-grip end cap 110 and a shaft 120. The shaft 120 has an elongated shape extending along an axial direction 240. The shaft 120 includes an end portion 210, a middle portion 220, and a head portion 230. The head portion 230 of the shaft 120 can be connected to a lacrosse head 130. The shaft 120 can include contoured surfaces on the end portion 210, the middle portion 220, and the head portion 230. In other words, the shaft 120 can have varied cross sections along the end portion 210, the middle portion 220, and the head portion 230.

At least a portion of the shaft 120 can have a hollow core 250 in the center. The end portion 210 includes an outer shell 215 having the hollow core 250. A cross section of the end portion 210 can have a polygonal shape such as an octagon. The middle portion 220 can also include an outer layer 225 around the hollow core 250. Similarly, the head portion 230 can include an outer layer 235 around the hollow core 250. A cross section of the head portion 230 can have a polygonal shape such as an octagon. The end portion 210 and the head portion 230 can have substantially the same cross-sectional shape such as an octagon.

The middle portion 220 can include three cured sides 221 and three corners 222 and 223, as shown in FIG. 2C. The corners 222 and 223 can be somewhat rounded to improve the shaft's look and feel. The shape of the middle portion 220 is designed to improve a player's hold on the shaft and to resist the twisting of the shaft 120 due to its shape near the corners 222 and 223. As the player's hold on the shaft 120 is improved, the middle portion 220 also enhances power, accuracy, and efficiency. A middle portion in a lacrosse shaft is often the most vulnerable to breaking on a cross-check. The cross-sectional shape of the disclosed middle portion 220 can enhance strength of the middle portion 220 relative to some conventional shafts having octagonal cross sections in the middle portions.

The middle portion 220 can further provide a player with enhanced control over the shaft 120. The corner 223 can be more pointed than the other two corners 222. In other words, the corner 223 can have a more acute angle than the corners 222. The lacrosse head 130 can be mounted in alignment with the more protruded corner 223. For example, the opening of the lacrosse head 130 can be aligned along the corner 223. The corner 223 can be used by the player as a tactile indication to the orientation of the lacrosse head 130. A player can know the orientation of the lacrosse head by simply touching the middle portion 220 without looking at the lacrosse stick or head. This feature is particularly beneficial in assisting beginning players to correctly position their hands for throwing without having to look at the stick.

The end portion 310, the middle portion 220, and the head portion 230 can extend respectively along an axis in the axial direction 240 of the shaft 120. The end portion 310 and the head portion 230 can have substantially the same cross-sectional shape and can be defined by a common axis. The centers at different cross sections of the middle portion 220 can also define an axis for the middle portion 220. The axis of the middle portion 220 can be substantially parallel to the axis of the end portion 210 or the head portion 230.

The middle portion 220, together with the head portion 230 and the end portion 210, can provide for variable hand placement along the shaft 120 as players move their hands up and down the shaft 120 during cradling, throwing, and stick handling. The middle portion 220 can also give a player a reference point when moving the player's hands along the shaft 120 without the need for the player to look at the shaft.

Figure 2F:
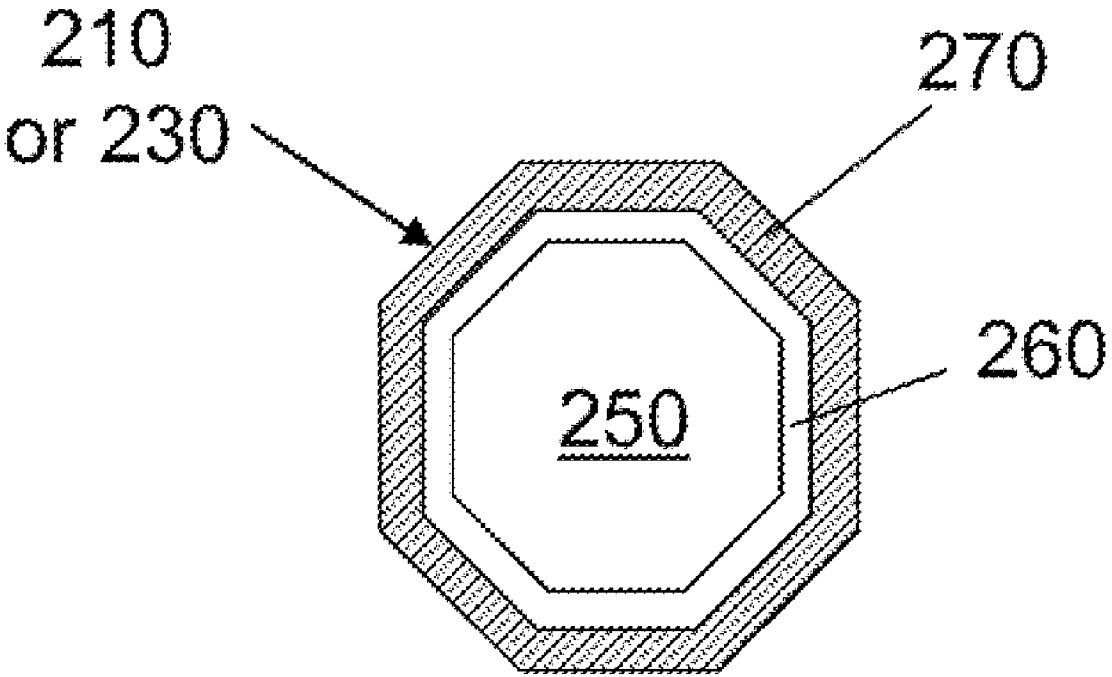
FIG. 2F is an exemplified cross-sectional view of the contoured lacrosse shaft along line A-A or C-C in FIG. 2A.
Figure 3A:
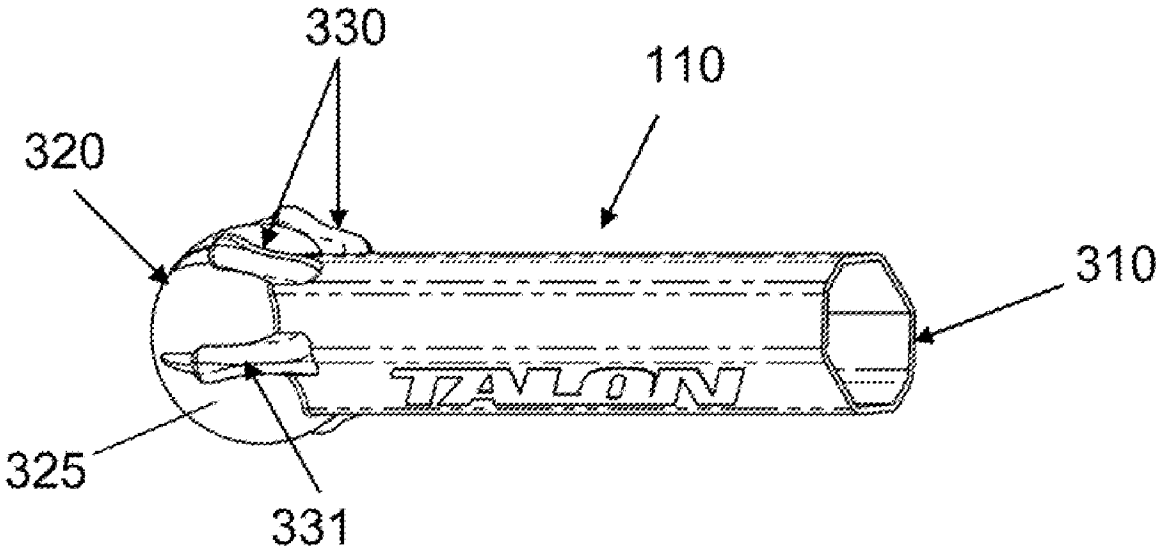
FIG. 3A is a detailed perspective view of the talon-grip end cap in FIG. 1.
Figure 3B:
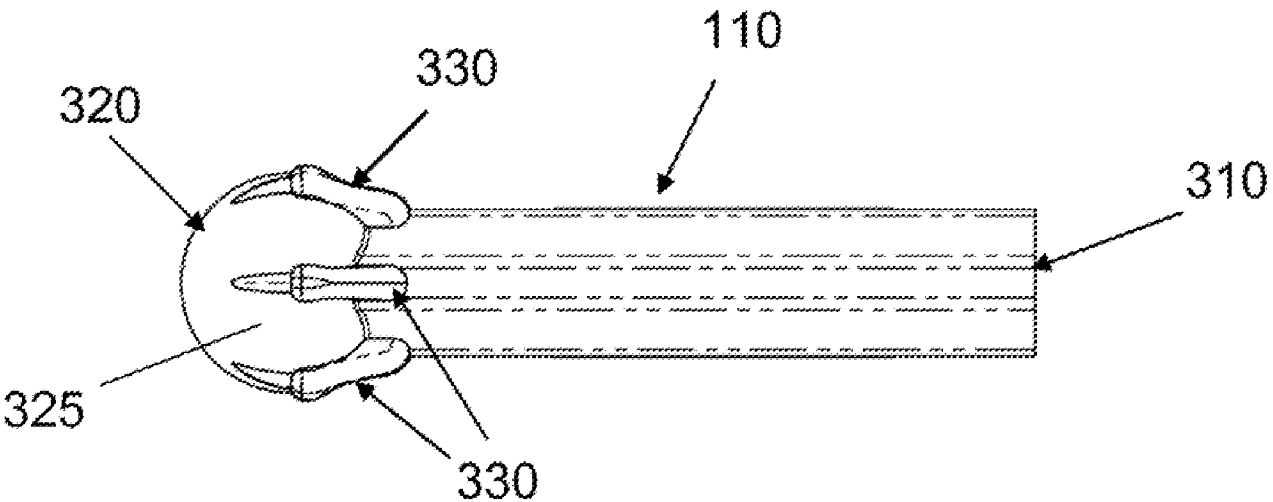
FIG. 3B is a top view of the talon-grip end cap of FIG. 3A.
Figure 3C:
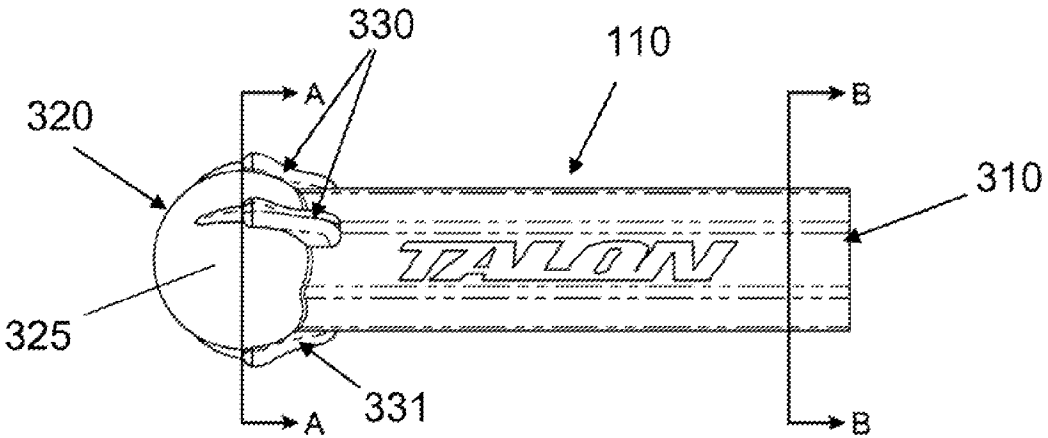
FIG. 3C is a side view of the talon-grip end cap of FIG. 3A.
Figure 3E:
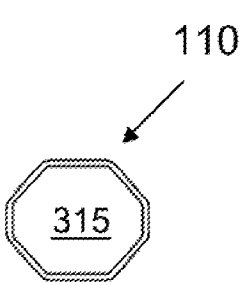
FIG. 3E is a cross-sectional view of the talon-grip end cap along line B-B in FIG. 3C.
Figure 3D:
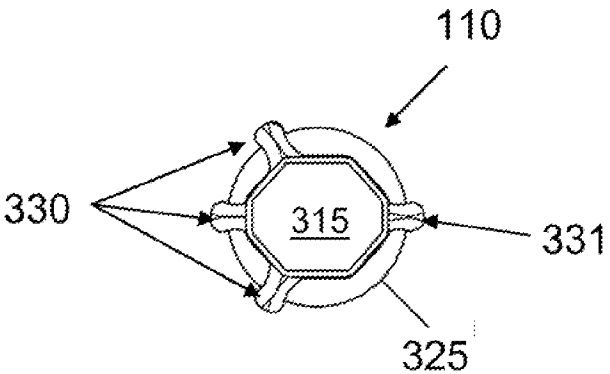
FIG. 3D is a cross-sectional view of the talon-grip end cap along line A-A in FIG. 3C.

In some embodiments, shown in FIG. 2F, the outer layers 215, 225, and 235 can include an interior portion 260 and an outer layer 270 on an outer surface of the interior portion 260. The interior portion 260 can include a hollow core 250. The interior portion 260 can be made of fiberglass, aluminum, chrome, aluminum alloy, titanium, Kevlar, scandium, magnesium, or a composite material such as graphite loaded plastics. The outer layer 270 can wrap around the interior portion 260. In some implementations, the outer layer 270 can cover a longitudinal segment or an angular section of the interior portion 260. The thickness of the outer layer can for example be in a range of 0.003 inch to 0.5 inch, or a range of 0.01 inch to 0.1 inch.

The outer layer 270 can be made of wood veneer. The wood veneer can include glued laminated wood, laminated veneer lumber (LVL), laminated wood sheets, and laminated veneer sheets. The wood veneer can be fused on the interior portion 260 by applying heat using a glue such as a urethane resin to form the outer layer 270. Similar layered structures can be formed along the axial direction 240 through end portion 210, the middle portion 220, and the head portion 230.

In combination with the interior portion 260, the outer layer 270 made of wood veneer can provide a dent resistant and durable surface to the shaft 120. In contrast to conventional materials such as aluminum, metal alloys, and carbon composites, the wood veneer does not dent or nick on impact and is thus a superior surface for a lacrosse shaft. Additionally, the wood veneer does not break into shards or pieces having sharp edges and is therefore safer than conventional shaft designs. Furthermore, the combination of the interior portion 260 made of fiberglass and an outer layer 270 made of wood veneer allows the shaft 120 to flex and return to its original shape. In contrast, conventional shaft materials based on metals and alloys tend to bend and retain bent shapes, which can thereby weaken the shaft. The improved flexibility in the shaft 120 provides for greater impact strength and improved shot speed. Advantageously, an outer layer 270 made of wood veneer has low heat conductivity and is suitable for a variety of weather conditions. Additionally, the wood veneer can provide desirable tactile features including a tacky and slip resistant surface.

Referring to FIGS. 3A to 3E, the end cap 110 can include a sleeve portion 310 and a round portion 320. The sleeve portion 310 can have a hollow core 315. The sleeve portion 310 is sized and configured to fit on the outside of the end portion 210 of the shaft 120. The sleeve portion 310 can be frictionally slipped onto the end portion 210 to cap the end portion 210. The end cap 110 can thereby improve a player's grip of the end of the shaft 120 to prevent the shaft 120 from slipping from the player's hands. The length of sleeve portion 310 obviates the need for a player to apply tape to a shaft as the sleeve portion 310 is securely fit to the end portion 210. In use, the end cap 110 can provide far improved grip and leverage when passing and shooting. The increased diameter of the sleeve portion 310 relative to the diameter of the end portion 130 further prevents the stick from slipping out of the player's hand.

The sleeve portion 310 can be made from an elastic material such as rubber. The elastic material can be slightly stretched to allow the sleeve portion 310 to be slipped over the end portion 210 of the shaft 120. The sleeve portion 310 can have an elongate shape that is parallel to the axial direction of the shaft 120 when the sleeve portion 310 is slipped onto the end portion 210 of the shaft 120. The sleeve portion 310 of the end cap 110 can have a polygonal cross section such as an octagon.

The round portion 320 of the end cap 110 creates leverage and torque for improved shot speed. The round portion 320 includes a curved and convex surface 325. At least a portion of the surface 325 can have a spherical shape. The round portion 320 includes protruded grip features on the surface 325 of the round portion 320. The protruded grip features can include one or more talons 330, 331 disposed on the outer surface of the round portion in the end cap. Three talons 330 can be disposed on a first side of the round portion. The talon 331 can be disposed on a second side of the round portion opposite to the first side. The talons 330, 331 on the surface 325 can further improve a player's grip of the end cap 110 as well as provide tactile clues for the correct position of the lacrosse head 130 at the head portion 230 of the shaft 120.

The disclosed lacrosse stick can include one or more of the following advantages. The disclosed lacrosse stick can provide improved shaft control, and higher flexibility. The disclosed shaft can provide higher strength, especially in the middle portion, in comparison with the conventional lacrosse shafts. The disclosed lacrosse shaft may be less likely to break in vulnerable situations such as a cross-check. The disclosed shaft also provides an end cap that can provide improved leverage and torque and thus improved shot speed. The materials and structures of the disclosed lacrosse stick can also make the lacrosse stick to be dent resistant and extremely durable. The surface of the lacrosse stick can have desirable tactile features such as being tacky and slip resistant. The disclosed shaft can also provide a player a tactile indication to the orientation of the lacrosse head, which allows a player to know the orientation of the lacrosse head without looking at the lacrosse stick. The disclosed end cap can provide leverage and torque for improved shot speed. The grip features such as talons on the surface of the end cap can further improve a player's grip of the end cap as well as provide tactile clues for correct hand position on the shaft.

It is understood that the disclosed sticks are applicable to a wide range of recreational and/or competitive sports such as ice hockey and field hockey, in addition to lacrosse. Different materials and manufacture processes can be used to manufacture the talon-grip end cap and the contoured shafts. The shapes and dimensions of the end cap and the structured or contoured shafts can also differ from the examples described above. The lacrosse stick can be compatible with a different number of talons as grip features. For example, there can be one, two, three, five, or more talons disposed on the end cap or elsewhere on the lacrosse stick. The talons can also be distributed at different locations and groupings from the descriptions above. The disclosed shaft is also compatible with other contoured shapes. For example, the cross section of a shaft can be oval, elliptical, rectangle with rounded corners, etc. The cross section of a shaft may also include a combination of flat portions and curved portions.

What is claimed is:

1. A structured lacrosse shaft, comprising:

a head portion configured to be connected to a lacrosse head;

an end portion configured to be capped by an end cap; and a middle portion, wherein at least one of the head portion, the end portion, or the middle portion comprises an interior portion and an outer layer on an outer surface of the interior portion, wherein the outer layer comprises laminated sheets of wood veneer, wherein the outer layer has a thickness in a range of 0.01 inch to 0.1 inch, wherein the interior portion comprises a hollow core, wherein the interior portion comprises a fiberglass material wherein the laminated sheets of wood veneer are fused on the interior portion.

2. The structured lacrosse shaft of claim 1, wherein the combination of the outer portion and the interior portion has a substantially uniform thickness around a shaft axis in the cross-sections at the head portion, the end portion, or the middle portion.

3. The structured lacrosse shaft of claim 1, wherein each of the head portion, the end portion, and the middle portion comprises the interior portion and the outer layer on an outer surface of the interior portion.

4. The structured lacrosse shaft of claim 1, wherein the outer layer comprises laminated wood sheets or laminated veneer sheets.

5. The structured lacrosse shaft of claim 1, wherein a cross section of the middle portion has a different number of edges from the numbers of edges in the cross sections at the head portion and at the end portion.

6. The structured lacrosse shaft of claim 1, wherein a cross section of the middle portion of the shaft comprises three sides and three corners, wherein the three corners have acute angles and one of the three corners has a more acute angle than the other two of the three corners.

7. The structured lacrosse shaft of claim 1, wherein the outer layer comprises glued laminated wood or laminated veneer lumber.

8. A contoured lacrosse shaft, comprising:

a head portion configured to be connected to a lacrosse head;

an end portion configured to be capped by an end cap; and a middle portion, wherein at least one of the head portion, the end portion, and the middle portion comprises a hollow core, wherein each of the head portion, the end portion, or the middle portion comprises an interior portion and an outer layer comprising laminated sheets of wood veneer wrapping around an outer surface of the interior portion, wherein the combination of the outer portion and the interior portion has a substantially uniform thickness around a shaft axis in the cross-sections at the head portion, the end portion, or the middle portion, and wherein a cross section of the middle portion has a different number of edges from numbers of edges in the cross sections at the head portion and at the end portion, wherein the outer layer has a thickness in a range of 0.01 inch to 0.1 inch wherein the laminated sheets of wood veneer are fused on the interior portion and wherein the interior portion comprises a material selected from the group of fiberglass, aluminum alloy, titanium, Kevlar, scandium, magnesium, and graphite loaded plastics.

9. The contoured lacrosse shaft of claim 8, wherein the outer layer comprises laminated wood sheets or laminated veneer sheets.

10. The contoured lacrosse shaft of claim 8, wherein a cross section of the middle portion of the shaft comprises three sides and three corners, wherein one of the three corners has an angle smaller than angles of the other two of the three corners.

11. A lacrosse stick, comprising:

a structured shaft comprising:

a head portion configured to be connected to a lacrosse head;

an end portion configured to be capped by an end cap; and a middle portion, wherein at least one of the head portion, the end portion, or the middle portion comprises an interior portion comprising a fiber glass material and an outer layer wrapping around an outer surface of the interior portion, wherein the interior portion comprises a fiber glass material, wherein the outer layer comprises laminated sheets of wood veneer, wherein the outer layer has a thickness in a range of 0.01 inch to 0.1 inch, wherein the interior portion comprises a hollow core; and an end cap comprising:

a sleeve portion configured to cap the end portion of the shaft; and a round portion having one or more protruded grip features on a surface of the round portion wherein the laminated sheets of wood veneer are fused on the interior portion.

12. The lacrosse stick of claim 11, where the combination of the outer portion and the interior portion has substantially the same thickness around a shaft axis at the middle portion, at the head portion, and at the end portion.

13. The lacrosse stick of claim 11, wherein a cross section of the middle portion has a different number of edges from numbers of edges in the cross sections at the head portion and at the end portion.

14. The lacrosse stick of claim 11, wherein a cross section of the middle portion of the shaft comprises three sides and three corners, wherein one of the three corners has an angle smaller than angles of the other two of the three corners.

15. The lacrosse stick of claim 11, wherein the sleeve portion of the end cap is configured to be frictionally fit onto the end portion of the shaft, thereby capping the end portion of the shaft.

16. The lacrosse stick of claim 11, wherein the one or more protruded grip features comprise four talons disposed on the outer surface of the round portion in the end cap.

* * * * *